US006116433A

United States Patent [19]

Pursall

[11] Patent Number: 6,116,433

[45] Date of Patent: Sep. 12, 2000

[54] DISPLAY SYSTEMS

[76] Inventor: Robert Wallace Pursall, 63 Cadleigh Gardens, Harborne, Birmingham, United Kingdom, B17 0QB

[21] Appl. No.: 09/171,378

[22] PCT Filed: Apr. 14, 1997

[86] PCT No.: PCT/GB97/01016

§ 371 Date: Oct. 16, 1998

§ 102(e) Date: Oct. 16, 1998

[87] PCT Pub. No.: WO97/39663

PCT Pub. Date: Oct. 30, 1997

[30] Foreign Application Priority Data

Apr. 19, 1996 [GB] United Kingdom ..... 9608177

[51] Int. Cl.[7] ..... B42F 7/00

[52] U.S. Cl. ..... 211/55

[58] Field of Search ..... 211/55, 163, 164, 211/DIG. 1; 40/661.01, 493, 494, 621, 600

[56] References Cited

U.S. PATENT DOCUMENTS

| | | | |
|---|---|---|---|
| 2,532,600 | 12/1950 | Broersma | 211/55 |
| 3,269,556 | 8/1966 | Streater | 211/132.1 |
| 4,613,047 | 9/1986 | Bushyhead et al. | 211/55 |
| 4,938,366 | 7/1990 | Carroll | 211/55 |
| 5,184,737 | 2/1993 | Hardy | 211/55 |
| 5,938,048 | 8/1999 | Carroll et al. | 211/55 |

FOREIGN PATENT DOCUMENTS

| | | |
|---|---|---|
| 2 650 944 | 2/1991 | France . |
| 29 35 496 A1 | 3/1981 | Germany . |
| 414757 | 8/1934 | United Kingdom . |
| 1 482 997 | 8/1977 | United Kingdom . |
| 2 206 035 | 12/1988 | United Kingdom . |

*Primary Examiner*—Daniel P. Stodola
*Assistant Examiner*—Erica B. Harris
*Attorney, Agent, or Firm*—Davis and Bujold

[57] ABSTRACT

A display system has a pair of uprights (11), a shelf unit (40) and a pair of brackets (20), each bracket (20) including a formation (21) for engagement of a complementary formation (14) on one of the uprights (11) by which the bracket (20) may be hung from the upright (11). The bracket (20) also includes a surface (24) for supporting the shelf unit (40) and a formation (37) for engaging a complementary formation (32) on a second bracket (20) by which the second bracket (20) may be supported on the first bracket (20).

26 Claims, 5 Drawing Sheets

DISPLAY SYSTEMS

The present invention relates to display systems and in particular display systems for newspapers, magazines and the like.

It is known to provide display systems for newspapers, magazines and the like which comprise one or more shelves, each shelf being formed from a trough section so that the shelf has front and rear walls to retain the newspaper etc on the shelf. The front wall extends only part way up the newspaper or the like or is made of transparent material, for display purposes. The shelves are conventionally supported on uprights by means of brackets which engage the shelf at each end.

Several such shelves may be combined together to form a multiple shelf array in which one shelf is located forwardly and below the preceding shelf. Hitherto, such multiple shelf arrays have required special support brackets which will provide support for each of the shelves of the array. As a result, it is necessary to provide different support brackets depending on whether the bracket is to support one, two or more shelves.

The present invention provides a display system of modular construction, in which a single support bracket design may be used to support a single shelf or a plurality of shelves in a multi-shelf array.

According to one aspect of the present invention, a display system comprises; a pair of uprights, a shelf unit and a pair of brackets; said bracket each including a formation for engagement of a complimentary formation on one of the uprights by which the bracket may be hung from the upright; means for supporting and locating one end of the shelf; and means for supporting and locating a similar bracket, so that said similar bracket is located forwardly of said bracket.

With the display system according to the present invention, several brackets may be interconnected to provide a multi-shelf array using a single design of bracket.

According to a preferred embodiment of the present invention, the means for supporting and locating the shelves permits axial adjustment relative to the shelf, so that variations in the spacing of the uprights may be accommodated.

The uprights may be secured to a suitable support structure for example a wall or may be provided on a free standing display stand.

The invention is now described by way of example only, with reference to the accompanying drawings, in which.

Figure 1:
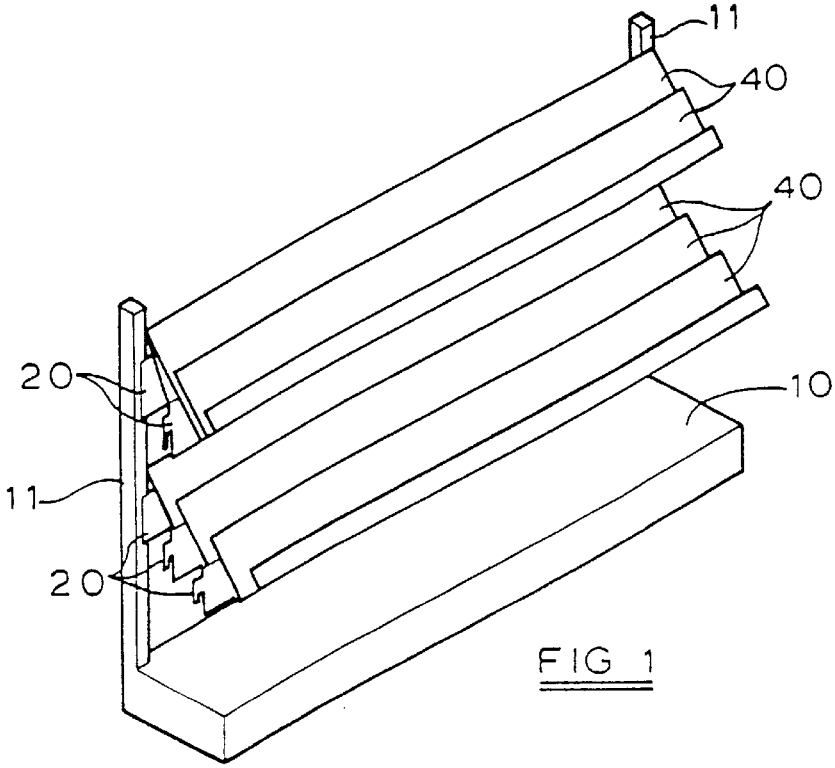
FIG. 1 is an isometric view of a display system in accordance with the present invention.

As illustrated in FIGS. 1 to 5, a display system comprises a base member 10 with a pair of uprights 11 extending one from each of the rear corners of the base member 10.

Each of the uprights 11 has a longitudinally extending groove 12 in its front face 13, longitudinally spaced slots 14 being provided in the base 15 of the groove 12.

Brackets 20 may be located in the groove 12, a hook formation 21 on each bracket 20 locating in one of the slots 14, to engage the web portion 16 between said one slot 14 and the slot 14 below it, to locate the bracket 20 longitudinally of the upright 11. A pair of brackets 20 will be located, one in each of the uprights 11, at equal heights, to support the ends of a shelf unit 40. Several such pairs of brackets 20 may be located in the uprights 11 to support shelf units 40 at different heights.

Figure 2:
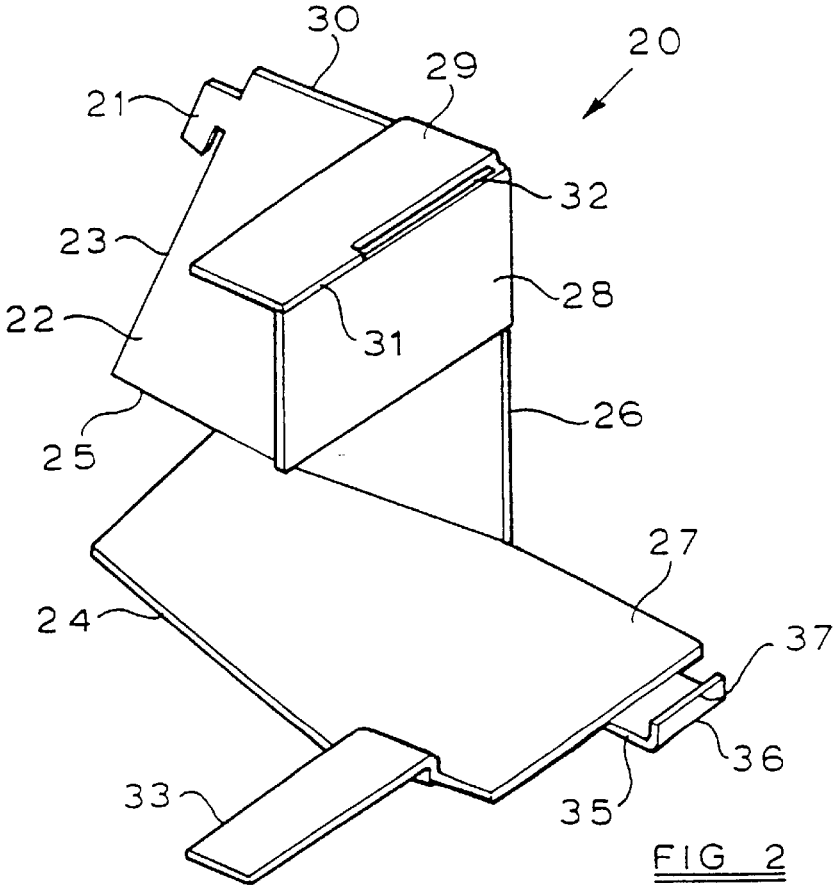
FIG. 2 is an isometric view of a bracket of the display system illustrated in FIG. 1.

As illustrated in greater detail in FIG. 2, each bracket 20 is formed from sheet metal and comprises a vertically disposed portion 22, the rear edge 23 of which may be located in the groove 12 of the upright 11. The hook formation 21 extends rearwardly in the plane of the vertically disposed portion 22, from the rear edge 23 adjacent the upper end thereof.

A shelf unit supporting portion 24 extends at right angles to the vertically disposed portion 22 from the bottom edge 25 thereof. The rear edge 23 of the vertically disposed portion 22 is inclined to the bottom edge 25, so that when the rear edge 23 engages the vertical upright 11, the shelf unit supporting portion 24 and shelf unit 40 supported thereby, will be inclined upwardly from back to front. The shelf unit support portion 24 extends from a position spaced inwardly of the rear edge 23 of vertically disposed portion 22, to a position spaced forwardly of the front edge 26 of the vertically disposed portion 22. The shelf unit 40 is supported on the forward portion 27 of the shelf unit supporting portion 24.

The front edge 26 of the vertically disposed portion 22 extends at right angles to the forward portion 27 of the shelf unit support portion 24. An abutment portion 28 extends a right angle from the upper end of the front edge 26, to form an abutment for a rear wall 44 of the shelf unit 40.

A bracket interconnecting portion 29 extends from the top edge 30 of the vertically disposed portion 22 adjacent the front edge 26. An inner portion of the front edge 31 of the bracket interconnecting portion 29, is cut away and the outer portion is secured to the upper edge of the abutment portion 28 by for example welding, to define a slot 32 at the junction between the abutment portion 28 and the bracket interconnecting portion 29.

A tongue formation 33 extends from the forward portion 27 of the shelf unit support portion 24 from the edge thereof which is remote from the vertically disposed portion 22. The tongue formation 33 is joggled so that it extends parallel to but spaced above the plane of the shelf unit support portion 24.

The various portions of the bracket 20 described so far are preferably pressed out of a single sheet of material.

A tab formation 35 is secured to the underside of the forward portion 27 of shelf unit supporting portion 24, by for example spot welding. The tab formation 35 is aligned parallel to the vertically disposed portion 22 and within the vertical projection of slot 32. The tab formation 35 is spaced from the underside of shelf unit support portion 24 and extends forwardly thereof, the front end 36 of the tab formation 35 being turned upwardly to define a lip formation 37.

It will be appreciated that the brackets 20 used at each end of the shelf unit will be of similar design but of opposite hand.

Figure 3:
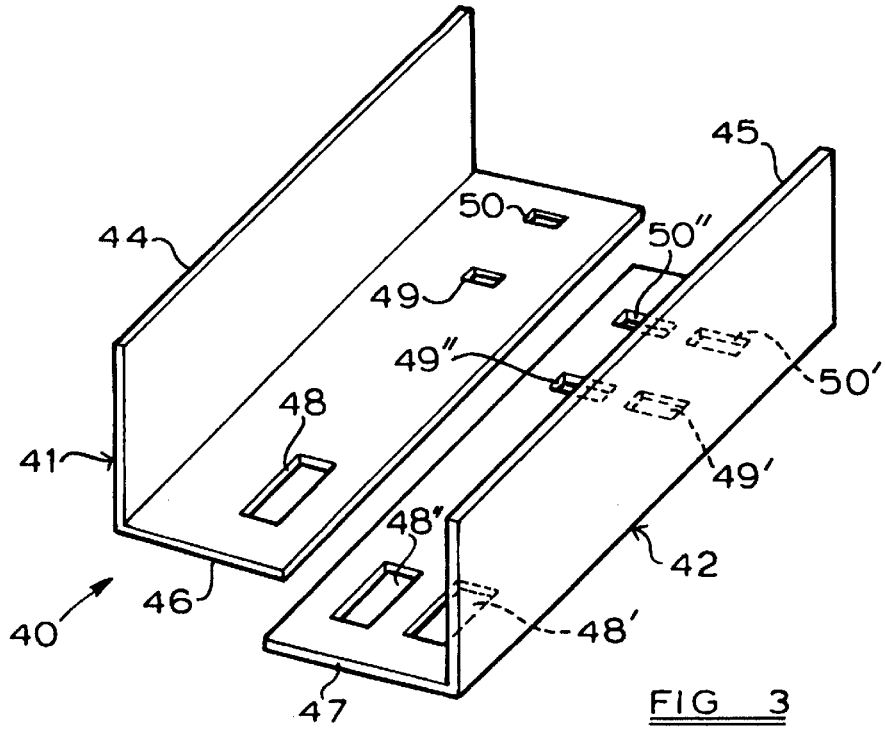
FIG. 3 is an exploded isometric view of a shelf assembly for the display system illustrated in FIG. 1.
Figure 4:
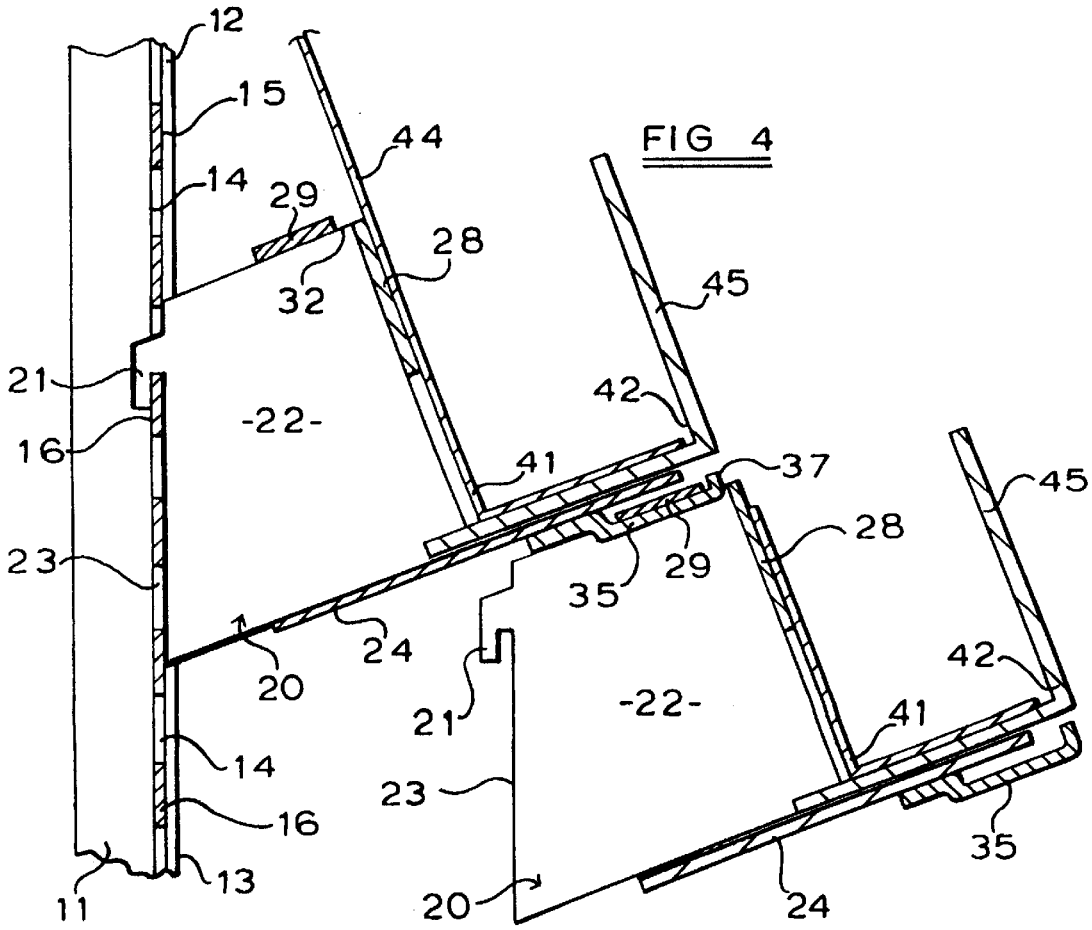
FIG. 4 is a part sectional view of a detail of the display system illustrated in FIG. 1.

As illustrated in FIG. 3, the shelf unit 40 is formed in two parts 41 and 42. Part 41 is formed of sheet metal and defines the rear wall 44 of the shelf unit 40. Part 42 is made of transparent plastics material and defines a front wall 45. Part 41 of the shelf unit 40 has a base portion 46 which, in the assembled shelf unit 40, will overlie a base portion 47 of part 42.

The base portion 46 of part 41 has a single longitudinally extending aperture 48 adjacent one end and a pair of longitudinally aligned narrow apertures 49, 50 adjacent the other end. The base portion 47 of part 42, which is wider than the base portion 46 of part 41, is provided with two sets of apertures 48', 49', 50' and 48", 49", 50" which correspond in size and longitudinal position to the apertures 48, 49 and 50 of part 41, the two sets of apertures being arranged side by side. The apertures 48, 49 and 50 correspond in width to the width of the tongue formation 33 of the brackets 20.

Figure 5:
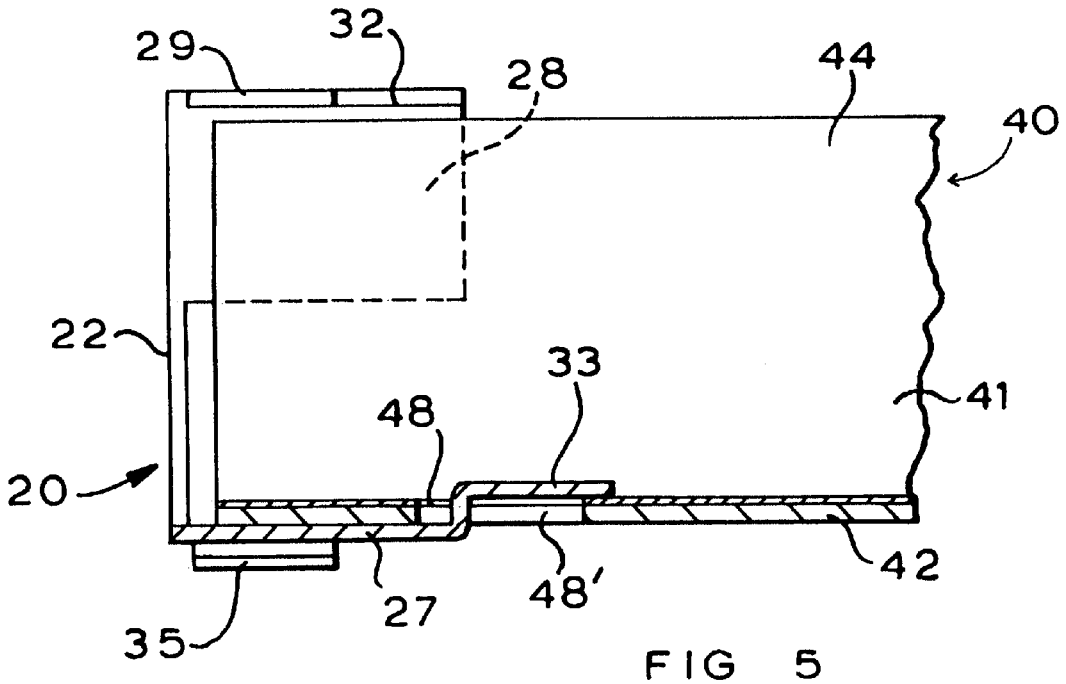
FIG. 5 is a part sectional view of a further detail of the display system illustrated in FIG. 1.

As illustrated in FIG. 5, the shelf assembly 40 is mounted on the brackets 20, so that the base portion 47 of part 42 abuts the forward portion 27 of the shelf unit supporting portion 24, while the rear wall 44 defined by part 41, abuts the abutment portion 28. In this position, the tongue formations 33 of the brackets 20 may engage through the apertures 48 and 49 or 50 of part 41 and apertures 48' and 49' or 50' in part 42 to form a narrow shelf unit 40 or apertures 48" and 49" or 50" to form a wide shelf unit 40. When assembled, the base portions 46, 47 of the shelf unit 40 are located between the upper surface of the shelf unit support portions 24 and the lower surface of the tongue formations 33. The elongate apertures 48, 48' and 48" at one end of the shelf unit 40 and the spaced apertures 49, 49', 49" and 50, 50', 50" at the other end of the shelf unit 40 allow longitudinal adjustment of the brackets 20 relative to the shelf unit 40, so that a standard length of shelf unit 40 may be used and variations in the spacing of uprights 11 accommodated, while engagement of the tongue 33 in one of the narrow apertures 49', 50', 49" or 50" locates the shelf unit 40 longitudinally.

While in the display system described above, the shelf unit 40 is formed in two parts, one part shelf units of trough section made of metal or transparent plastics material may alternatively be used. Where the shelf unit is made only of sheet metal, ribs may be provided adjacent each end to simulate the thickness of the combined metal/plastic shelf unit or an all plastic shelf unit, so that the metal shelf unit will be located properly between the shelf unit support portions 24 and the tongue formations 33.

As illustrated in FIG. 1, shelf units 40 of the display system in accordance with the present invention may be assembled in multi-shelf arrays. This is achieved by assembling the first shelf unit 40 in the manner described above. The second shelf assembly may then be assembled by locating a shelf unit 40 between a second pair of brackets 20. The brackets 20 of the second shelf assembly may then be supported on the brackets 20 of the first shelf assembly, by locating the bracket supporting portion 29 of the brackets 20 of the second shelf assembly, between the shelf supporting portion 24 and tab formation 35 of the brackets 20 of the first shelf assembly. The lip formations 37 of the tab formations 35 of the brackets 20 of the first shelf assembly engage in the slots 32 of the brackets 20 of the second shelf assembly, to retain the brackets 20 of the second shelf assembly in position. Several such shelf assemblies may be assembled in this manner, into a multi-shelf array.

With multi-shelf arrays of this type, only the foremost shelf assembly will require a transparent front wall and consequently it may be more appropriate to form the other shelf assemblies of the array, using one-piece sheet metal shelf units 40.

While in the above embodiment, the display system has been described with reference to a self standing support structure, the uprights 11 may alternatively be secured to a suitable structural element, for example a wall. Display systems in accordance with the present invention may also be provided with several spans of shelf unit 40 located between three or more uprights 11. The grooves 12 and slots 14 in the uprights 11 are consequently dimensioned to accommodate two brackets 20 of opposite hand, in side by side relationship.

While in the above embodiment a separate tab formation 35 is provided to support one bracket 20 on a preceding bracket 20 in a multi-shelf array, the tab formation 35 may alternatively be formed as a tongue formation which is pressed out of the forward portion 27 of the shelf unit supporting portion 24 of the bracket 20.

Figure 6:
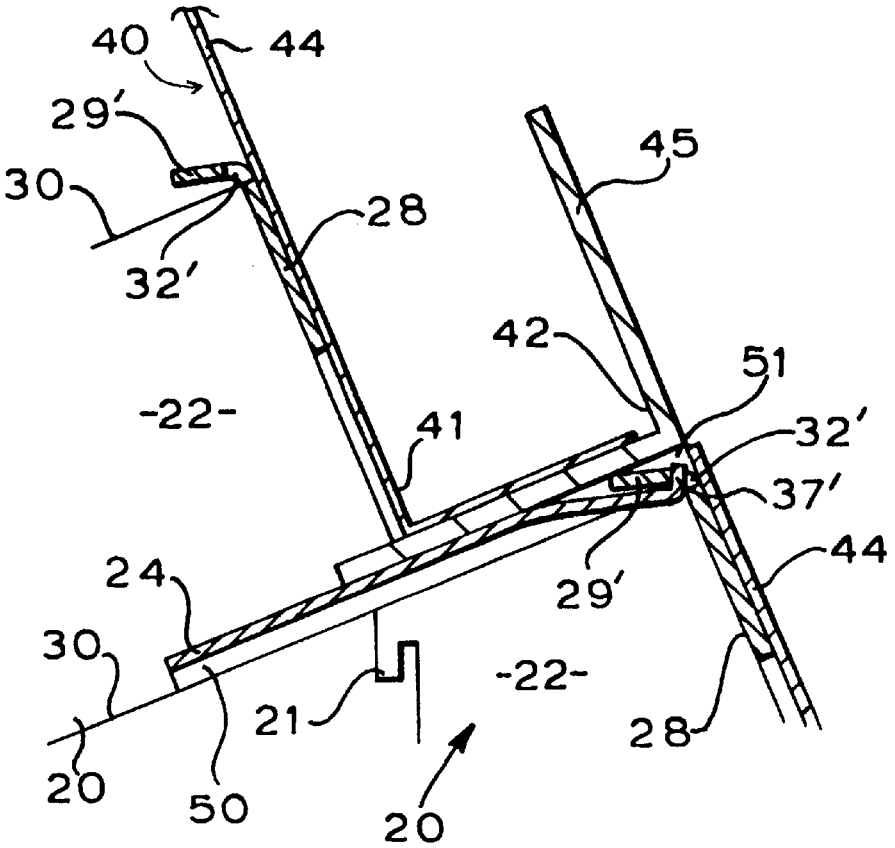
FIG. 6 is a part sectional view, similar to FIG. 4 illustrating a modification to the display system illustrated in FIG. 1.

In the modification illustrated in FIG. 6, the shelf unit support portion 24 of bracket 20, has a reinforcing rib 50, part 42 of the shelf unit 40 being supported on the upper surface of the rib 50. The bracket interconnecting portion 29' extends from the upper edge of abutment portion 28 and is inclined upwardly away from the abutment portion 28 relative to the top edge 30 of the vertically disposed portion 22. A slot 32' is provided at the folded junction between the abutment portion 28 and the bracket interconnecting portion 29'.

The forward end of the shelf unit supporting portion 24 is bent downwardly and the lip formation 37' is formed along its forward edge.

The lip formation 37' is located such that when a shelf unit 40 is supported on the rib 50, a gap 51 which is slightly wider than the gauge of the bracket interconnecting portion 29' is provided between the lip formation 37' and the underside of the shelf unit 40.

With this modified embodiment, in order to assemble a multi-shelf array, the first shelf assembly is assembled and supported on the uprights 11, in the manner described above. A second shelf assembly may then be assembled by locating a shelf unit 40 between a pair of brackets 20. The second shelf assembly is then offered up to the first shelf assembly, the second shelf assembly being tilted rearwardly, so that the bracket interconnecting portions 29' of the brackets 20 of the second shelf assembly are disposed parallel to the underside of the shelf unit 40 of the first shelf assembly. The bracket interconnecting portions 29' of the brackets 20 of the second shelf assembly may then be inserted into the gaps 51 between the lip formation 37' and underside of shelf unit 40, of the first shelf assembly. The lip formations 37' of the brackets 20 of the first shelf assembly may then be located in the slots 32' of the brackets 20 of the second shelf assembly, by rotating the second shelf assembly so that the top edges 30 of the brackets 20 thereof engage the under surface of the shelf unit supporting portion 24 of the brackets 20 of the first shelf assembly. The second shelf assembly will be held in this position by the weight of the shelf assembly and the articles thereon. In this position, the rearward edge of the bracket interconnecting portions 29' of the brackets 20 of the second shelf assembly engage the underside of the shelf unit 40 of the first shelf assembly, thereby preventing disengagement of the lip formation 37' from the slots 32'.

In order to disengage the second shelf assembly from the first shelf assembly, the bottom of the second shelf assembly must be moved forwardly so that the bracket interconnecting portions 29' of the brackets 20 of the second shelf assembly are brought parallel to the base of the shelf unit 40 of the first shelf assembly and the bracket interconnecting portions 29' may then be withdrawn through the gaps 51.

Figure 7:
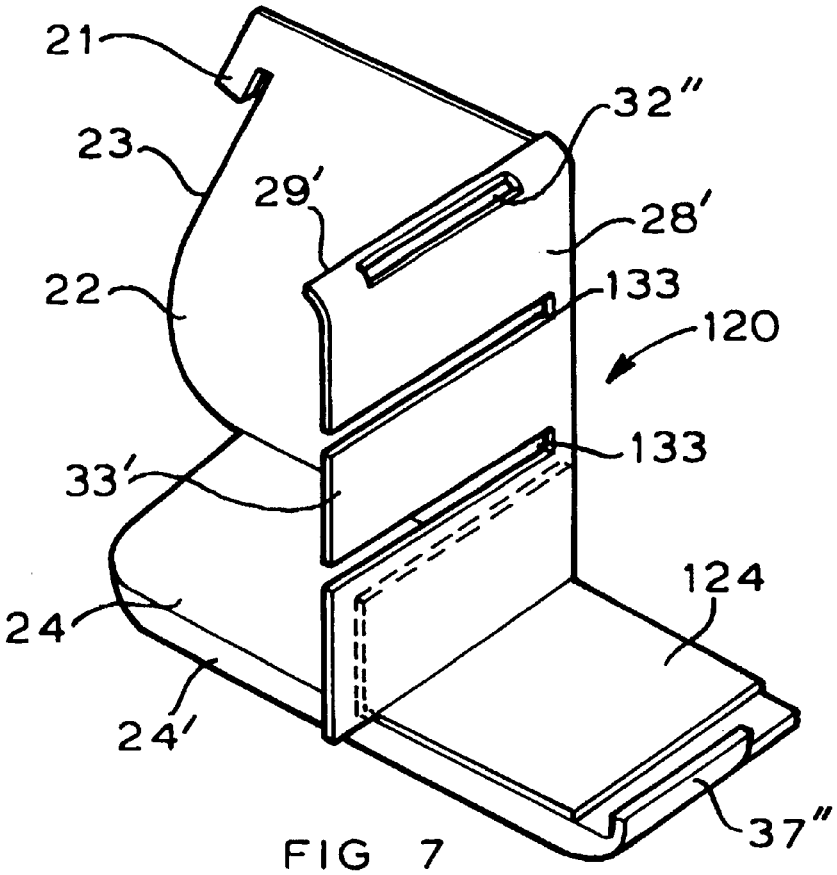
FIG. 7 is a view similar to FIG. 2 of a modified bracket for use in accordance with the present invention.

In the modified bracket 120 illustrated in FIG. 7 the shelf supporting portion 24 has a flange formation 24' running from front to rear along the edge thereof remote from the vertically disposed portion 22. The lip formation 37" is defined by the forward edge of shelf supporting portion 24.

The abutment portion 28' extends the full height of the vertically disposed portion 22 and is secured to the shelf supporting portion 24 by an L-shaped reinforcing plate 124, which may be secured to the shelf supporting portion 24 and abutment portion 28' in suitable manner, for example, spot welding.

The upper edge 29' of the abutment portion 28' is bent over towards the rear of the bracket 120 and the slot 32" is formed therein.

A pair of vertically separated horizontally extending slots 133 is provided in the abutment portion 28', the slots 1 33 opening to the free edge of the abutment portion 28' to form a tongue formation 33'.

Figure 8:
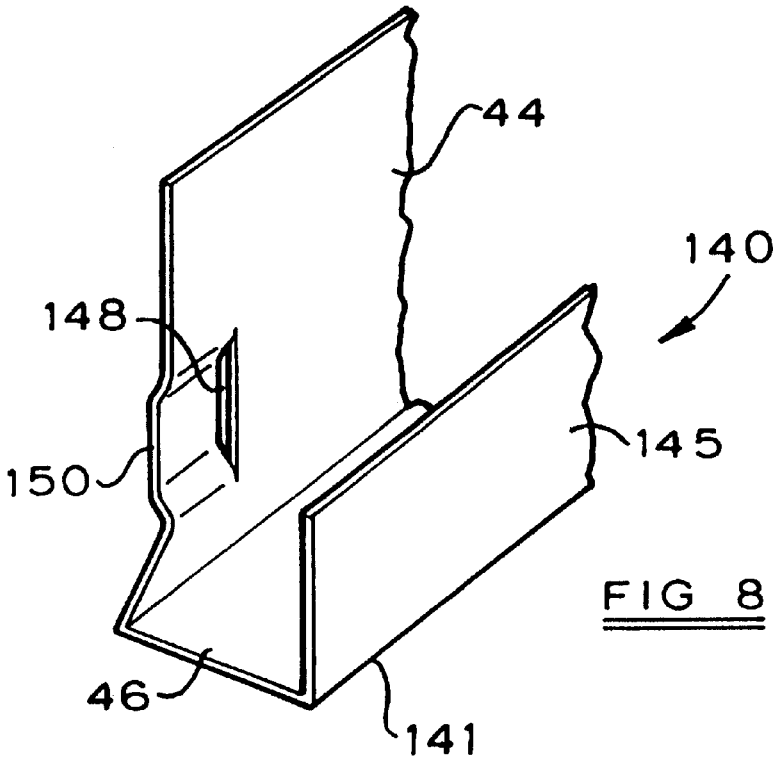
FIG. 8 is an isometric view of one end of a shelf unit for use with the modified bracket illustrated in FIG. 7.

As illustrated in FIG. 8 a shelf unit 140 comprises a channel section 141 made of sheet metal, the channel section defining front and rear walls 145, 144 and a base 146. The front wall 145 is of reduced height relative to the back wall 144. At each end of the shelf unit 140 a vertically extending slot 148 is provided in the rear wall, adjacent the vertically extending edge thereof. The portion 150 of the back wall 144 between the slot 148 and edge is deformed rearwardly, so that when the shelf unit 140 is mounted on the bracket 120 and the base 146 of the shelf unit engages the shelf supporting portion 24, the tongue formation 33' may be inserted through the slot 148, the tongue formation 33' abutting the front face of the deformed portion 150 and the rear face of the back wall 144, to locate the shelf unit 140 on the bracket 120. The tongue formation 33' extends longitudinally of the shelf unit 140 and thereby allows a degree of longitudinal adjustment of the shelf unit 140 relative to the brackets 120.

Figure 9:
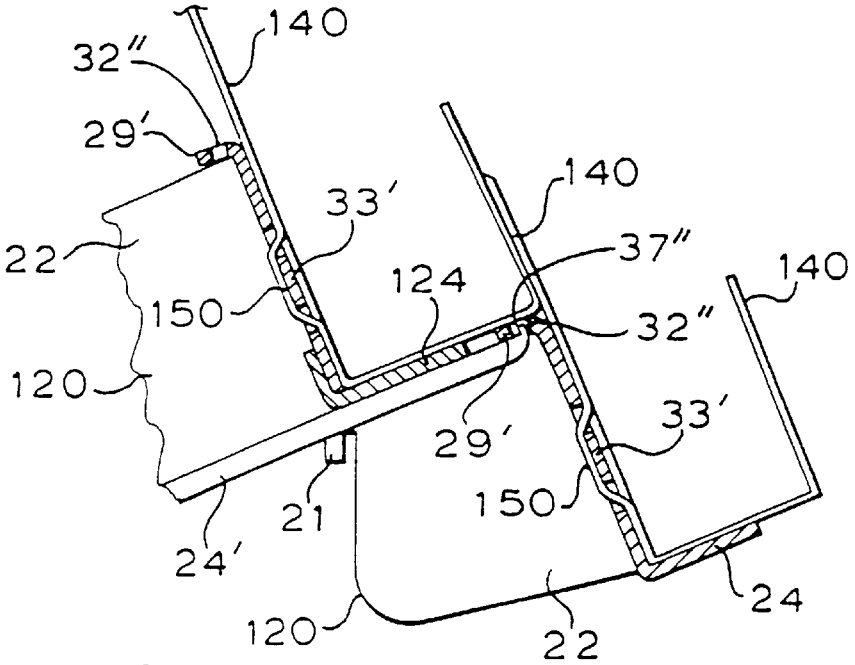
FIG. 9 is a view similar to FIG. 4 illustrating a sectional view of the display system using the bracket illustrated in FIG. 7.

As illustrated in FIG. 9, the lip formation 37" of one bracket 120 may engage in the slot 32" of a second bracket 120 so that the one bracket 120 is supported forwardly of the second bracket 120. When the shelf unit 140 is fitted to the rearward bracket 120, it overlies the upper edge 29' of the forward bracket 120, thereby preventing detachment thereof.

As illustrated in FIG. 9, the foremost bracket 120 of a display may be modified so that the shelf supporting portion 24 forms a flat supporting surface with no reinforcing flange 24' and no lip formation 37", which may otherwise detract from the appearance of the display system.

Figure 10:
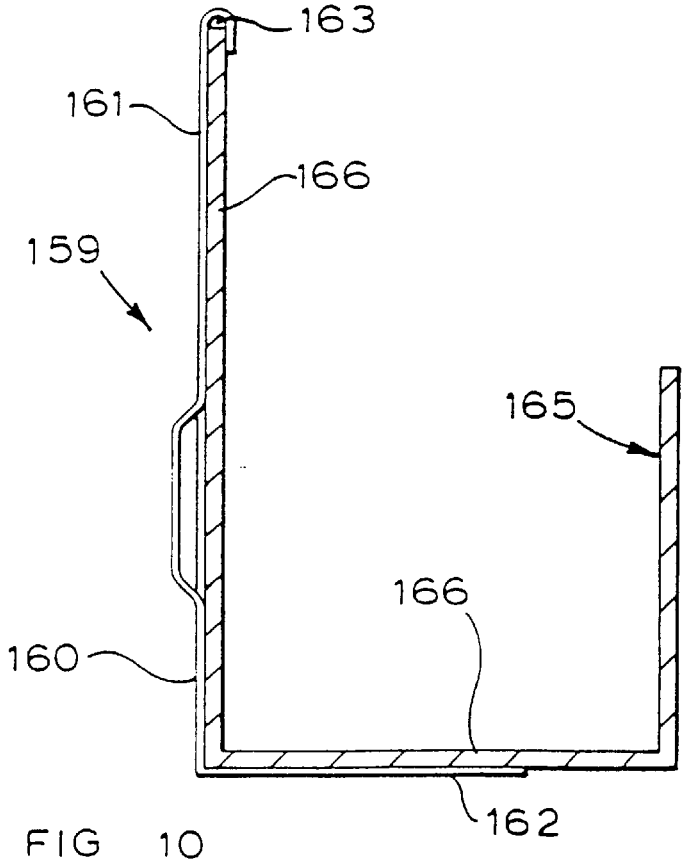
FIG. 10 illustrates a support means for use with the bracket illustrated in FIG. 7, for use with a plastic shelf unit.

The modified display system illustrated in FIGS. 7 to 9 may also be adapted for use with plastic shelving units, by means of the support member 159 illustrated in FIG. 10. As illustrated in FIG. 10, support member 159 comprises an L-shaped bracket 160 defining a back wall 161 and a base portion 162. The upper edge of the back wall 161 is turned over to form a channel 163. Slot formations 148, 150 similar to those formed in the shelf units 140 are provided in the back wall 161 of the bracket 160, by which it may be mounted with respect to a bracket 120. Support members 159 of the form illustrated in FIG. 10 are mounted at each end of a plastic shelf unit 165, the back wall 166 of the shelf unit 165 engaging in the channel 163 of the support member 159 and the base 166 of the shelf unit 165 abutting the base portion 162. The plastic shelf unit 165 may then be mounted on the brackets 120 in similar manner to the shelf unit 140.

What is claimed is:

1. A display system comprising a pair of uprights (11), a shelf unit (40), and a pair of first brackets (20; 120), said first brackets (20; 120) each including: a formation (21) for engagement of a complimentary formation (14) on one of the uprights (11) by which the first bracket (20; 120) may be hung from the upright (11), first support surface (24) for supporting and locating one end of the shelf unit (40) from beneath and a second support surface (28) for supporting and locating one end of the shelf unit (40) from the rear; wherein each bracket (20; 120) has first and second complimentary formations (32, 37; 32', 37'; 32",37") and a pair of second brackets (20; 120) of the same design as the first brackets (20; 120), wherein a respective second bracket may be supported on the first bracket (20; 120) by engagement of the first formation (37; 37'; 37") on the first bracket (20; 120) with the complimentary second formation (32; 32'; 32") on the second bracket (20; 120), so that the first and second support surfaces (24, 28) of the second bracket (20; 120) are located forwardly and below a forward edge of the support surface (24) of the first bracket (20; 120).

2. The display system according to claim 1, wherein the support surface (24) for the shelf unit (40) is inclined with respect to the formation (21) for engagement of a complimentary formation (14) on the upright (11), such that when the bracket (20, 120) engages the upright (11), the support surface (24) and the shelf unit (40) supported thereby will be inclined upwardly from back to front.

3. The display system according to claim 1, wherein each bracket (120) defines an abutment surface (28') against which the shelf unit (40) abuts when mounted on the bracket (120), the abutment surface (28') defining a formation (33') and a complimentary formation (148,150) being provided on a rear wall (44) of the shelf unit (40) for engagement by the formation (33') on the bracket (120), in order to secure the shelf unit (40) to the bracket (120).

4. The display system according to claim 3, wherein one of the formations (33', 148,150) on the abutment surface (28') of the bracket (120) and the rear wall (44) of the shelf unit (40) extends longitudinally of the shelf unit (40) in order to accommodate longitudinal adjustment of the shelf unit (40) with respect to the bracket (120).

5. The display system according to claim 4, wherein a tongue formation (33') is provided on the abutment surface (28') of the bracket (120), the tongue formation (33') extending longitudinally of the shelf unit (40) and being adapted to engage a slot formation (148, 150) in the rear wall (44) of the shelf unit (40).

6. The display system according to claim 1, wherein each bracket (20,120) defines a support surface (24) for the shelf unit (40).

7. The display system according to claim 6, wherein a formation (33) is associated with the support surface (24) for engagement of corresponding formation (48, 49, 50) on the shelf unit (40) to locate the shelf unit (40) with respect to the support surface (24).

8. The display system according to claim 7, wherein the formation (33) associated with the support surface (24) and the corresponding formation (48, 49, 50) on the shelf unit (40) permits longitudinal adjustment of the shelf unit (40) relative to the bracket (20).

9. The display system according to claim 8, wherein the formation (33) associated with the support surface (24) comprises a tongue formation (33) which extends longitudinally of the shelf unit (40) and parallel to but spaced above the plane of the support surface (24), the shelf unit (40) being located between the support surface (24) and the tongue formation (33).

10. The display system according to claim 9, wherein the tongue formation (33) of a bracket (20) disposed at each end of the shelf unit (40) engages through an aperture (48, 49, 50) in each end of the shelf unit (40).

11. The display system according to claim 10, wherein an aperture (48) at one end of the shelf unit (40) is elongate longitudinally of the shelf unit (40).

12. The display system according to claim 10, wherein a plurality of longitudinally spaced apertures (49, 50) are provided at one end of the shelf unit (40).

13. The display system according to claim 1, wherein each bracket (20, 120) includes a first support formation (29, 29') located above and rearwardly of said means (24) for supporting and locating one end of the shelf unit (40) and a second support formation (27, 35, 37' 37") located below and forwardly of said means (24) for supporting and locating one end of the shelf unit (40), the first support formation (29, 29') of a second bracket (20, 120) being engageable with the second support formation (27, 35, 37', 37") of a first bracket (20, 120), so that the second bracket (20, 120) will be supported forwardly and below the first bracket (20, 120).

14. The display system according to claim 13, wherein said second support formation comprises a pair of spaced surfaces (27, 35) between which said first support formation (29) of a second bracket (20) may locate.

15. The display system according to claim 13, wherein the first and second support formations (29, 27, 35) are locked together by rotation of the second bracket (20) with respect to the first.

16. The display system according to claim 13, wherein the first and second support formations (29, 29', 27, 37, 37', 37") include interengaging formations (32, 37, 32', 37', 32", 37") which engage when the second bracket (20, 120) is located with respect to the first bracket (20, 120).

17. The display system according to claim 16, wherein a slot (32, 32', 32") is provided in the first support formation (29, 29') and a lip formation (37, 37', 37") is provided on the second support formation, the lip formation (37, 37' 37") engaging in the slot (32, 32', 32"), when the second bracket (20, 120) is located with respect to the first bracket (20, 120).

18. The display system according to claim 1, wherein the shelf unit (40) is of trough section.

19. The display system according to claim 18, wherein the shelf unit (40) is made of sheet metal or plastics material.

20. The display system according to claim 19, wherein the plastics material is transparent.

21. The display system according to claim 19, wherein the shelf unit is made of plastics material and a sheet metal support member (159) is provided for mounting at each end of the plastic shelf unit (40), each support member (159) being adapted to be mounted on and secured to a bracket (120).

22. The display system according to claim 19, wherein the shelf unit is formed by a front part and a rear part.

23. The display system according to claim 22, wherein the rear part (41) is formed from sheet metal and the front part (42) is formed from transparent plastics material.

24. The display system according to claim 22, wherein formations (48, 49, 50, 48', 49', 50', 48", 49", 50") on the front and rear parts (41, 42) of the shelf unit are engageable with corresponding formations (33) on the bracket (20), by which the shelf unit (40) may be assembled to give a shelf of different widths.

25. A display system comprising; a pair of uprights (11), a shelf unit (40), and a pair of first brackets (20, 120); said first brackets (20, 120) each including; a formation (21) for engagement of a complimentary formation (14) on one of the uprights (11) by which the first bracket (20,120) may be hung from the upright (11) and means (24) for supporting and locating one end of the shelf unit (40), wherein means (37, 37' 37") is provided for supporting and locating a second pair of brackets (20, 120), so that said second brackets (20, 120) are disposed forwardly and below said first brackets (20, 120);

each bracket (20, 120) defines a support surface (24) for the shelf unit (40) where a tab formation (33) is associated with the support surface (24) for engagement of corresponding slot formation (48, 49, 50) on the shelf unit (40) to locate the shelf unit (40) with respect to the support surface (24), the tab formation (33) associated with the support surface (24) and the corresponding slot formation (48, 49, 50) on the shelf unit (40) permits longitudinal adjustment of the shelf unit (40) relative to the bracket (20);

wherein the tab formation (33) associated with the support surface (24) comprises a tongue formation (33) which extends longitudinally of the shelf unit (40) and parallel to but spaced above the plane of the support surface (24), the shelf unit (40) being located between the support surface (24) and the tongue formation (33).

26. A display system comprising; a pair of uprights (11), a shelf unit (40), and a pair of first brackets (20, 120); said first brackets (20, 120) each including; a formation (21) for engagement of a complimentary formation (14) on one of the uprights (11) by which the first bracket (20,120) may be hung from the upright (11) and means (24) for supporting and locating one end of the shelf unit (40), wherein means (37, 37' 37") is provided for supporting and locating a second pair of brackets (20, 120), so that said second brackets (20, 120) are disposed forwardly and below said first brackets (20,120);

wherein the shelf unit (40) is a trough section and made of sheet metal or plastics material and where the shelf unit is made of plastics material, a sheet metal support member (159) is provided for mounting at each end of the plastic shelf unit (40), each support member (159) being adapted to be mounted on and secured to a bracket (120).

* * * * *